US011608665B2

(12) United States Patent
Woodward et al.

(10) Patent No.: US 11,608,665 B2
(45) Date of Patent: Mar. 21, 2023

(54) LOW PROFILE FENESTRATION SCREEN ASSEMBLY AND METHOD FOR SAME

(71) Applicant: Marvin Lumber and Cedar Company, LLC, Eagan, MN (US)

(72) Inventors: Bradley D. Woodward, Warroad, MN (US); Ross Michael Hollermann, Salol, MN (US)

( * ) Notice: Subject to any disclaimer, the term of this patent is extended or adjusted under 35 U.S.C. 154(b) by 217 days.

(21) Appl. No.: 16/793,044

(22) Filed: Feb. 18, 2020

(65) Prior Publication Data

US 2020/0263463 A1 Aug. 20, 2020

Related U.S. Application Data

(60) Provisional application No. 62/807,176, filed on Feb. 18, 2019.

(51) Int. Cl.

| | |
|---|---|
| ***E05C 3/16*** | (2006.01) |
| ***E06B 9/52*** | (2006.01) |
| ***E06B 3/36*** | (2006.01) |
| ***E05C 3/04*** | (2006.01) |
| *E05C 7/02* | (2006.01) |

(Continued)

(52) U.S. Cl.

CPC ..... *E05C 3/165* (2013.01); *E05C 3/043* (2013.01); *E06B 3/36* (2013.01); *E06B 9/52* (2013.01); *E05C 7/02* (2013.01); *E06B 1/30* (2013.01); *E06B 3/222* (2013.01); *E06B 3/5828* (2013.01);

(Continued)

(58) Field of Classification Search

CPC . E05C 3/165; E05C 7/02; E05C 3/043; E06B 3/36; E06B 9/52; E06B 2009/527; E06B 1/30; E06B 3/222; E06B 3/5828; E06B 5/003

USPC ..... 52/204.5, 204.62, 204.67, 204.68, 204.1; 49/460

See application file for complete search history.

(56) References Cited

U.S. PATENT DOCUMENTS 383,155 A * 5/1888 Speer ..... E06B 9/52 160/230

516,873 A 3/1894 Murphy (Continued)

FOREIGN PATENT DOCUMENTS

CN 112144960 A * 12/2020 ..... E05B 15/00

DE 102015215863 A1 * 3/2016 ..... E06B 9/24

(Continued)

OTHER PUBLICATIONS

"U.S. Appl. No. 29/727,939, Ex Parte Quayle Action dated Dec. 22, 2021", 8 pgs.

(Continued)

*Primary Examiner* — Brent W Herring

(57) ABSTRACT

A fenestration assembly includes a low-profile screen assembly including a fenestration frame and a sash movably coupled with the fenestration frame. The sash includes a daylight opening having a daylight opening profile. The low-profile screen assembly is coupled with one or more of the fenestration frame or the sash. The low-profile screen assembly includes a screen panel having a screen frame coupled along one or more of the sash or the fenestration frame, and the screen frame includes a screen frame inner perimeter. A screen membrane spans the screen frame and is coupled with the screen frame. The screen frame inner perimeter is outside of the daylight opening profile.

26 Claims, 11 Drawing Sheets

(51) Int. Cl.

| | |
|---|---|
| *E06B 3/22* | (2006.01) |
| *E06B 3/58* | (2006.01) |
| *E06B 1/30* | (2006.01) |
| *E06B 5/00* | (2006.01) |

(52) U.S. Cl.
CPC ..... *E06B 5/003* (2013.01); *E06B 2009/527* (2013.01)

(56) References Cited

U.S. PATENT DOCUMENTS 751,668 A * 2/1904 Moskow ..... E06B 9/52 16/323
768,514 A 8/1904 Christen
1,453,280 A * 5/1923 Park ..... E06B 9/52 49/431
1,508,559 A * 9/1924 Koons ..... E06B 9/52 160/375
1,729,348 A * 9/1929 Koons ..... E06B 9/52 160/375
1,779,062 A * 10/1930 Alfonso ..... E06B 9/52 160/95
1,779,860 A * 10/1930 Shrauger ..... E06B 9/52 49/196
1,832,246 A * 11/1931 Sampson ..... E06B 9/52 160/19
1,941,432 A * 12/1933 Doering ..... E06B 9/52 49/342
2,151,295 A * 3/1939 Hucke ..... E06B 9/52 49/455
2,317,686 A * 4/1943 Kuyper ..... E06B 9/52 49/128
2,436,277 A * 2/1948 Willett ..... E06B 9/52 160/369
2,494,844 A * 1/1950 Tondora ..... E06B 9/52 160/92
2,604,156 A * 7/1952 Lillethorup ..... E06B 9/52 160/92
2,607,453 A * 8/1952 Smith ..... E06B 3/325 52/204.53
2,742,676 A 4/1956 Klee
2,923,351 A * 2/1960 Zitomer ..... E06B 3/44 160/381
2,939,188 A * 6/1960 Wahlfeld ..... E06B 3/2605 160/90
2,975,830 A * 3/1961 McDonald ..... E06B 5/003 160/92
3,035,316 A 5/1962 Revell et al.
3,232,653 A * 2/1966 Wilson ..... E05C 1/163 292/169.18
3,396,489 A * 8/1968 Cirone ..... E05B 65/1033 49/281
3,455,080 A 7/1969 Meadows
3,461,609 A * 8/1969 Armstrong ..... E06B 3/5009 74/25
3,487,580 A * 1/1970 Holliday ..... E06B 3/26347 160/90
4,121,379 A 10/1978 Everson
4,219,971 A * 9/1980 Mauroner ..... E06B 3/4609 49/504
4,523,408 A * 6/1985 McConnell ..... E06B 3/44 49/419
4,784,417 A * 11/1988 Fleming ..... E05B 3/065 292/357
4,878,314 A * 11/1989 Blockinger ..... G08B 13/04 49/394
4,958,468 A * 9/1990 Nolan ..... E06B 3/9636 52/204.593
D363,557 S 10/1995 Lindgren
5,675,948 A * 10/1997 Boesch ..... E06B 3/38 52/204.55
D418,609 S 1/2000 Lindgren
6,055,782 A * 5/2000 Morton ..... E06B 3/44 49/504
6,079,475 A * 6/2000 Morgan ..... E06B 9/52 160/371
6,192,631 B1 * 2/2001 Kenkel ..... E06B 3/44 49/501
6,505,669 B2 * 1/2003 Lilie ..... E06B 9/04 160/90
6,506,112 B1 * 1/2003 Halbleib ..... E05C 17/16 454/225
7,083,205 B2 8/2006 Hall
D611,615 S 3/2010 Therrien
D618,822 S 6/2010 Card
8,322,079 B2 * 12/2012 Daniels ..... E06B 3/9632 49/63
D702,403 S 4/2014 Snow
D707,368 S 6/2014 Sanders-carroll
D711,551 S 8/2014 Kalkhoven et al.
9,109,384 B2 * 8/2015 Minter ..... E05C 9/10
D757,300 S 5/2016 Haberland et al.
D828,580 S 9/2018 Often et al.
D907,248 S 1/2021 DeBoer et al.
2014/0053678 A1 * 2/2014 Gottschling ..... E05B 63/0056 74/523
2014/0196376 A1 7/2014 Nguyen et al.
2015/0082702 A1 * 3/2015 Walter ..... E06B 9/04 49/56
2015/0308151 A1 * 10/2015 Minter ..... E05C 9/10 292/336.3
2017/0016263 A1 1/2017 Balbo
2017/0145731 A1 * 5/2017 Bolick ..... E06B 3/685
2018/0094477 A1 * 4/2018 Roberts ..... E06B 9/52
2020/0109595 A1 4/2020 Woodward et al.
2020/0263475 A1 8/2020 Hollermann
2020/0263490 A1 8/2020 Woodward et al.
2021/0087875 A1 * 3/2021 Roberts ..... E06B 9/52

FOREIGN PATENT DOCUMENTS

EP 1270864 A1 * 1/2003 ..... E06B 9/52
KR 200354560 Y1 * 6/2004
WO WO-2015161504 A1 * 10/2015 ..... E06B 9/52

OTHER PUBLICATIONS

"Marvin Signature Modern Casement Pushout Screen", from U.S. Appl. No. 29/727,939, Ex Parte Quayle Action dated Dec. 22, 2021, <https://www.marvin.com/products/collections/signature/modern/casement-push-out>, (Apr. 7, 2020), 1 page.
"U.S. Appl. No. 29/727,939, Notice of Allowance dated Mar. 23, 2022", 5 pgs.
"U.S. Appl. No. 29/727,939, Response filed Feb. 22, 2022 to Ex Parte Quayle Action dated Dec. 22, 2021", 6 pgs.
"Canadian Application Serial No. 194145, Response Filed Jul. 19, 2022 to Examiner's Report dated Oct. 19, 2021", W out Claims, 20 pgs.
"Canadian Application Serial No. 3072800, Examiner's Rule 86 2 Requisition dated Oct. 20, 2022", 4 pgs.

* cited by examiner

LOW PROFILE FENESTRATION SCREEN ASSEMBLY AND METHOD FOR SAME

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Marvin Lumber and Cedar Company (d/b/a Marvin Windows and Doors), Warroad, Minn. All Rights Reserved.

TECHNICAL FIELD

This document pertains generally, but not by way of limitation, to screens and fenestration assemblies including screens.

BACKGROUND

Screens are included with fenestration assemblies, such as windows and doors, to provide ventilation through the assemblies while at the same time preventing the ingress of pests (e.g., insects or the like) and debris, such as leaves. In double hung windows screens are installed on the exterior of the fenestration frame to provide interior access to sashes. In other fenestration assemblies, such as casement and awning window assemblies, screens are provided proximate the interior of the fenestration frame because the sashes open toward the exterior. By placing the screens on the interior movement of the sashes outwardly is not interrupted and the screens continue to function (e.g., prevent ingress).

The sashes are accessible in casement and awning type window assemblies from the interior by removing the screens. For instance, spring pins are included with screens, and are spring biased toward a projecting configuration. With the spring pins aligned with corresponding recesses on the frame the spring pins hold the screen in place. To remove the screen from the fenestration assembly the user pulls the spring pins away from the edges of the screen with manual manipulation, overcoming a spring bias, and draws the pins out of the recesses thereby freeing the screen for removal.

In other examples, screens include butterfly latches having knife like projections that are rotatable into and out of the screens. The butterfly latches include biasing elements that bias the knife projections out of a screen. The fenestration frame includes corresponding knife shaped recesses that receive the knife projections and thereby hold the screen in the fenestration assembly. The butterfly latches are manually manipulated (e.g., with fingers, fingernails, or the like) to overcome the bias of the biasing elements and rotate the knife projection into the screen and out of the knife shaped recesses thereby freeing the screen for removal.

SUMMARY

The present inventors have recognized, among other things, that a problem to be solved can includes easing the opening of screens to access components of fenestration assemblies, such as fenestration panels (e.g., sashes, doors or the like), while at the same time minimizing the profiles of screen assemblies that extend into daylight openings.

Spring pins and butterfly latches are in some examples, difficult to operate. Multiple pins or latches are each operated to withdraw the pins or latches from corresponding recesses in the fenestration assemblies. Additionally, the pins and latches are operated with finger manipulation including, but not limited to, grasping of the pins or flanges of butterfly latches with fingertips or fingernails. Operation of the pins or latches in a coordinated manner is difficult with finger manipulation, and even more difficult when manipulation is repeated for multiple pins or latches to free the screen for removal. Further still, installation of screens after removal requires precise alignment of the pins or latches with corresponding recesses on the frame while the pins or latches are in a withdrawn configuration to facilitate positioning of the pins or latches when released.

Additionally, the components of the spring pins or butterfly latches, in some examples, extend from the screen perimeter into the daylight opening of the fenestration assembly. The pins or latches are visible and interrupt the otherwise clean lines of the fenestration assembly. Minimizing the size of these features to minimize their profiles frustrates operation of the features (e.g., the pins are made smaller, latches are made smaller or the like). Features that are already difficult to operate with finger manipulation are made more difficult to operate when minimized. Conversely, increasing the size of these features to ease operation further interferes with the aesthetic features of the fenestration assembly.

The present subject matter provides a solution to these problem with low-profile screen assemblies for use with fenestration assemblies. As described herein, the screen panels of the screen assemblies each include a screen frame and a screen membrane spanning the screen frame. The screen frame is seated within a corresponding screen socket of the fenestration assembly, such as a recess, groove, furrow or the like configured for reception of the screen frame. The screen panel includes a screen latch that retains the screen along the fenestration frame and is readily operable with finger pressure (in contrast to tension or pulling) to release the screen assembly for removal from the fenestration assembly including rotation of the screen to an open configuration or decoupling from the fenestration assembly.

In one example, the screen latch includes a latch rocker coupled along the screen frame. The latch rocker, in a locked configuration, is flush with the screen frame, and accordingly is misaligned with the daylight opening of the fenestration assembly. For instance, the latch rocker is outside of the daylight opening (e.g., recessed, flush, has an incidental projection or ⅛ inch or less, 1/16 inch or less into the daylight opening or the like). When removal (e.g., opening, or decoupling) of the screen assembly is specified the latch rocker is pivoted, for instance by pushing an end of the latch rocker into the screen frame. The latch rocker pivots and a rocker anchor projecting from the latch rocker is rotated out of an anchor socket associated with the fenestration frame. Disengagement of the rocker anchor (e.g., a plug, tongue, flange or the like) from the anchor socket unlocks the screen panel to allow for removal including one or more of decoupling from the fenestration assembly or, in the example including a screen hinge, rotation around the screen hinge. Optionally the latch rocker is a toggle and remains in either of the locked or unlocked positions when moved. Accordingly, when unlocked the screen remains unlocked to facilitate opening of the screen in contrast to other screens that require ongoing manipulation to hold spring pins or butterfly latches open for removal of the screen. In another example, the latch rocker is biased to move toward the locked position to retain the screen panel in the locked configuration.

Additionally, the screen panel minimizes (e.g., eliminates or minimizes) interference with the daylight opening. For example, the screen frame of the screen panel includes a screen frame inner perimeter that is outside of a daylight opening profile of the fenestration assembly (e.g., flush to the daylight opening profile, recessed from the profile or the like). Further, because the latch rocker is flushly coupled with the screen frame the daylight opening remains exposed without interference from the hardware of the low-profile screen assembly. The screen frame is instead seated along the fenestration frame and a portion of the fenestration panel, such as a sash frame, and thereby blends with the structural components of the window without obstructing the daylight opening.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
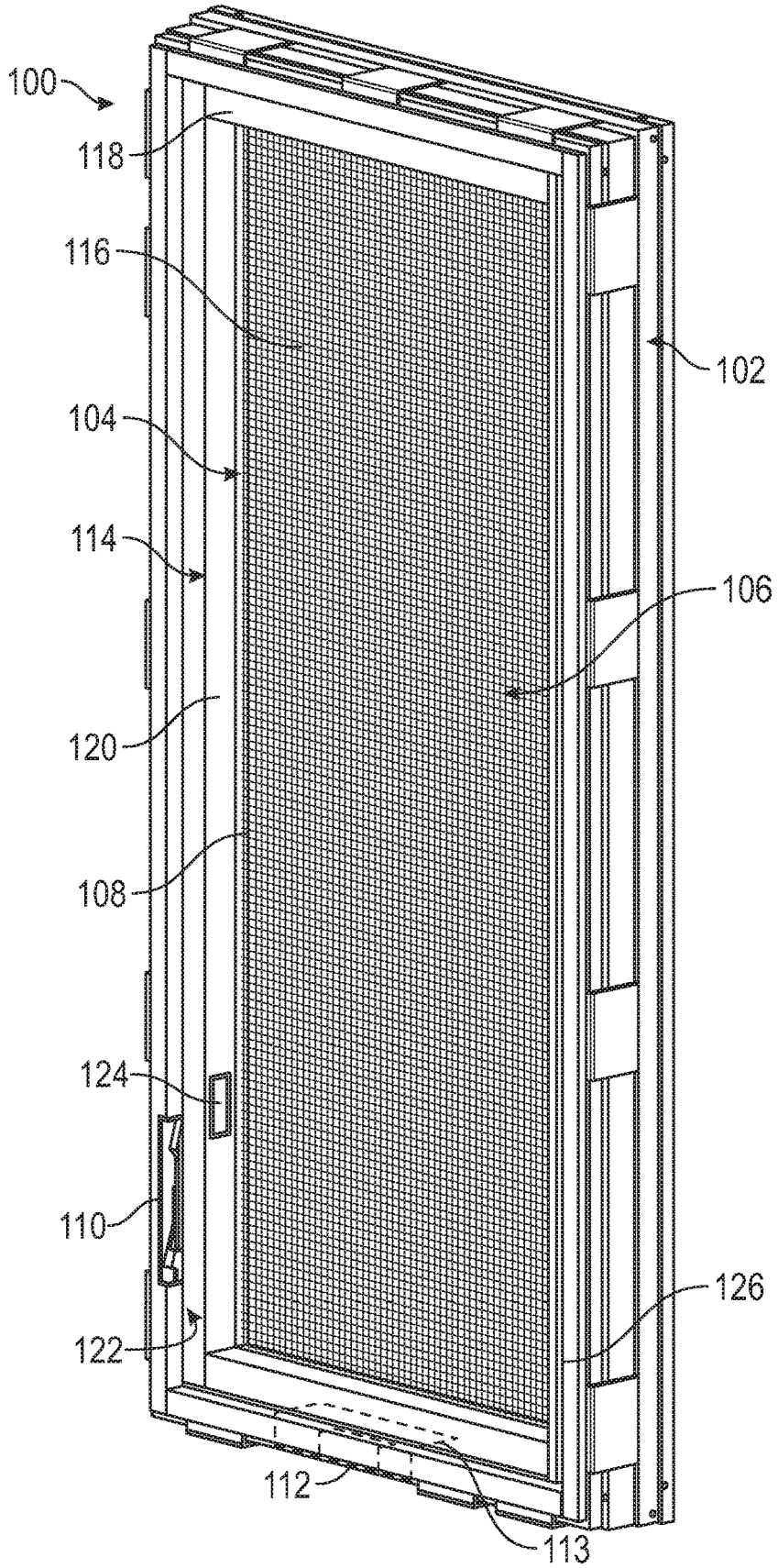
FIG. 1 is a perspective view of a fenestration assembly including one example of a low-profile screen assembly.

FIG. 1 illustrates generally a perspective view of a fenestration assembly 100 including an example low-profile screen assembly 114. The fenestration assembly 100 can include the low-profile screen assembly 114, a fenestration frame 102, a fenestration panel 104, a panel latch 110, an optional panel operator 112, and an operator mechanism 113. In certain examples, the fenestration panel 104 can include a sash, door, window glass or the like, and can define an opening profile 108 for, for example, a daylight opening 106. In certain examples, the fenestration panel 104 can move relative to the fenestration frame 102 such as to be opened or removed. In certain examples, the panel latch 110 can be used to latch the fenestration panel 104 in a "closed" position relative to the fenestration frame 102. The optional fenestration panel operator 112, and operator mechanism 113, can allow the fenestration panel 104 to be moved such as by a crank to open and close the fenestration panel 104 relative to fenestration frame 102. In some examples, once released by the panel latch 110, the fenestration panel 104 can be moved by hand to open and close the fenestration panel 104 relative to the fenestration frame 102.

The optional, operator mechanism 113 can assist movement of the fenestration panel 104 relative to fenestration frame 102. In certain examples, the operator mechanism 113 can include gears, sprockets, linkages, or other mechanisms to convert the movement of, for example, a hand of a user of the panel operator 112 to motion capable of opening and closing the fenestration panel 104 relative to the fenestration frame 102. In certain examples, the operator mechanism 113 can include limiting elements to resist uncontrolled motion of the fenestration panel 104 whether the fenestration assembly is equipped with an operator panel 112 or not. In certain examples, a limiting element can include a mechanical stop to limit a maximum "open" position of the fenestration panel 104 with respect to the fenestration frame 102.

In certain examples, the fenestration panel 104 can include the low-profile screen assembly 114. The low-profile screen assembly 114 can include a screen panel 118, an optional screen hinge assembly 126, and one or more screen latches 124. The screen panel 118 can include a screen frame 120 and screen membrane 116. In certain examples, an opening defined by a screen frame inner perimeter 122 of the screen frame 120 can be misaligned with the daylight opening 106 (e.g., outside the daylight opening profile 108). In some examples, the opening defined by the screen frame can be aligned with the daylight opening 106 (e.g., the screen frame 120 can have a coincident with, or overlies with, or has a corresponding profile to, one or more of the fenestration panel 104, fenestration frame 102, or the like.)

In certain examples, the screen panel 118 can be moved relative to the fenestration frame 102 such as for removing or opening the screen membrane 116 from spanning the daylight opening 106. In certain examples, the one or more screen latches 124 assist in maintaining the screen panel 118 in a fixed position relative to the fenestration frame 102 such that the screen membrane 116 generally overlies, is adjacent to, and is parallel with, the daylight opening 106. In certain examples, upon release of the one or more screen latches 124, the screen frame 120 and screen membrane 116 can be removed from the fenestration frame 102. In some examples, upon release of the one or more screen latches 124, the screen frame 120 and screen membrane 116 can be rotated via the screen hinge assembly 126 and opened with respect to the fenestration frame 102.

Figure 2A:
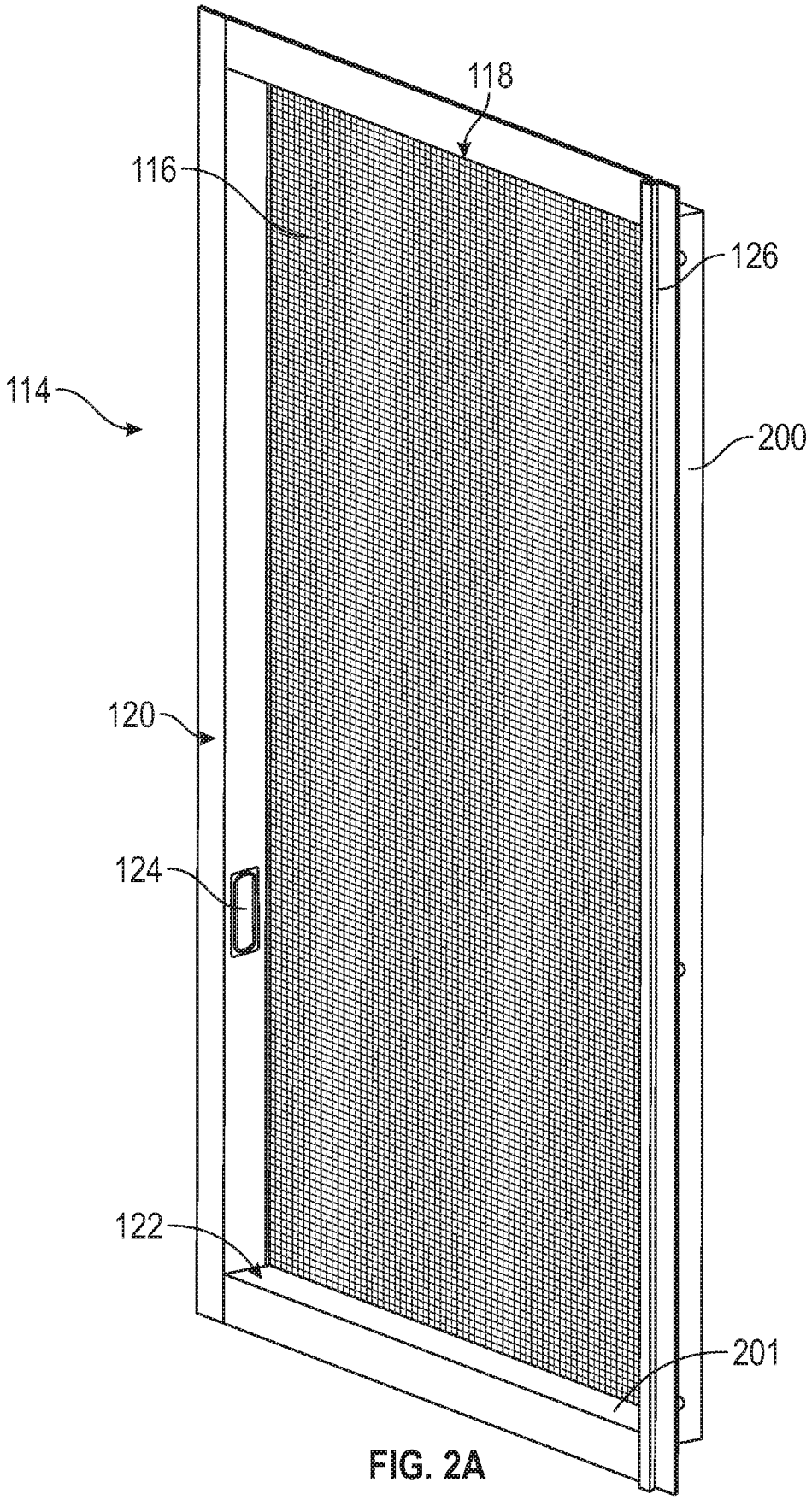
FIG. 2A is a sectioned view of the low-profile screen assembly of FIG. 1 including a screen hinge.
Figure 2B:
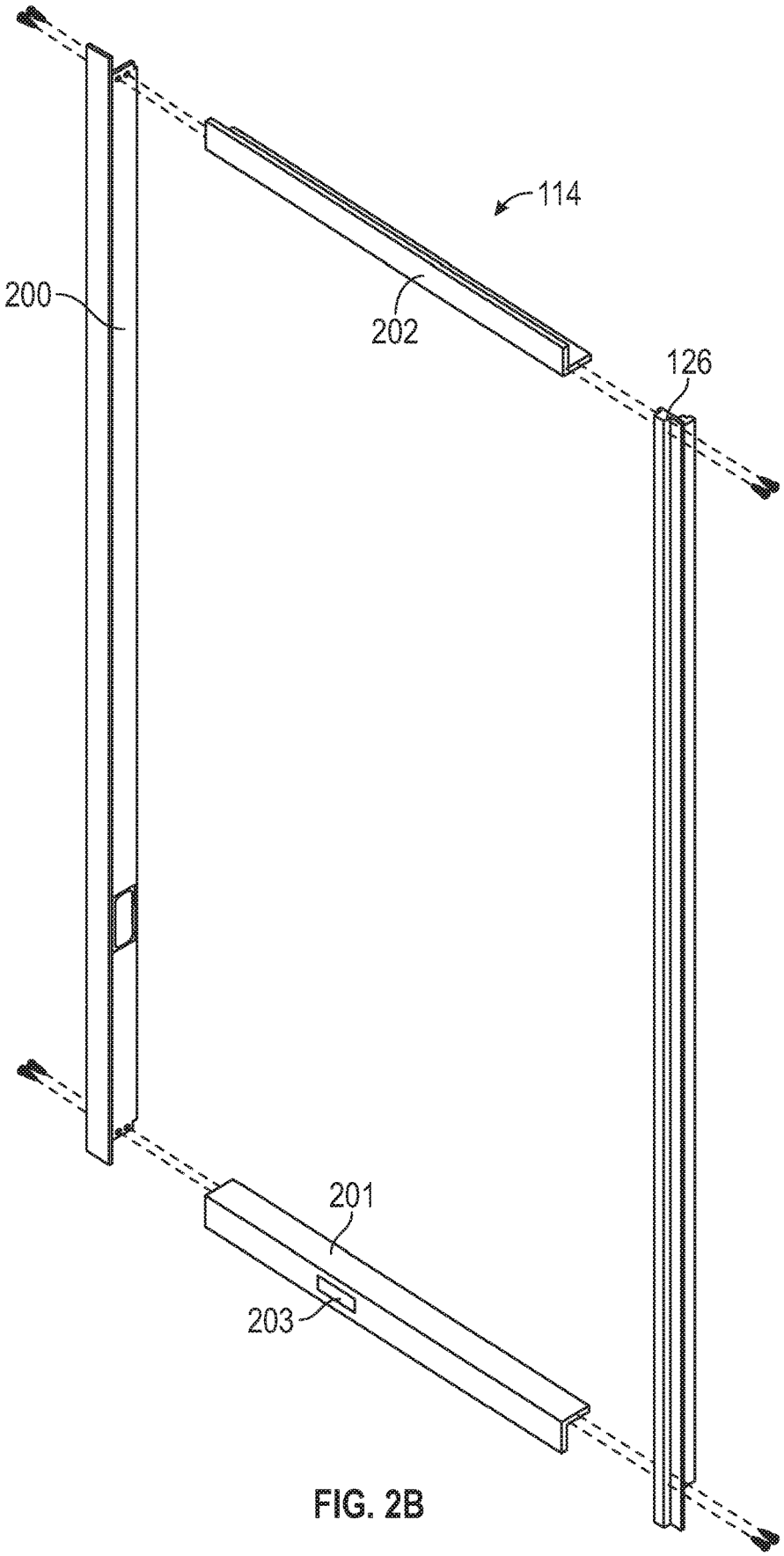
FIG. 2B is an exploded view of the low-profile screen assembly of FIG. 1.

FIGS. 2A and 2B illustrate generally an example low-profile screen assembly 114 according to the present subject matter. FIG. 2A is a sectioned view of the example low-profile screen assembly 114 of FIG. 1 including a screen hinge assembly 126. FIG. 2B is an exploded view of the low-profile screen assembly 114 of FIG. 1. In certain examples, the low-profile screen assembly 114 can include a screen frame 120, screen membrane 116 and optional screen hinge assembly 126, and one or more screen latches 124. The screen frame 120 can include screen jambs 200, a screen rail 201, and a screen head 202. Each of the jambs 200, rail 201 and head 202 can define a screen frame inner perimeter 122. In some examples, the screen frame inner perimeter 122 can be fitted to mis-align the daylight opening of the corresponding window or door such that the screen frame inner perimeter 122 lies outside the daylight opening profile (e.g., FIG. 1, 108) while the screen membrane 116 is fitted to span the daylight opening. In some examples, the screen rail 201 can include an operator opening 203 to accommodate an operator (e.g., crank or the like) of the fenestration panel 104.

Figure 3A:
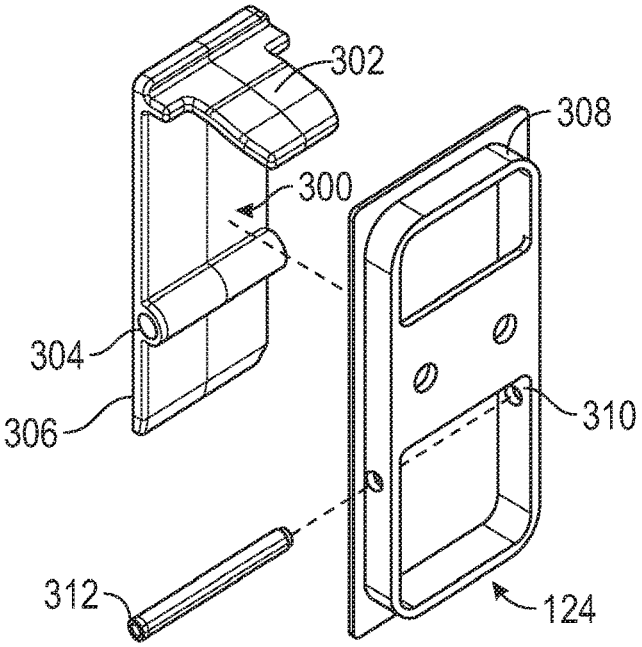
FIG. 3A is an exploded view of one example of a screen latch.
Figure 3B:
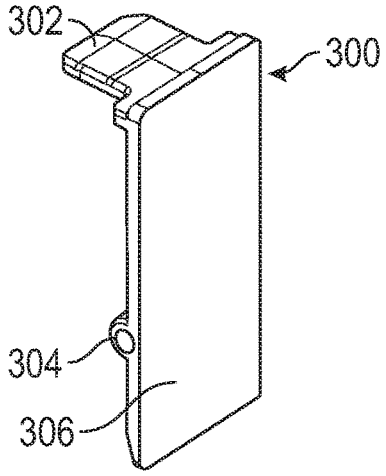
FIG. 3B is a perspective view of one example of a latch rocker.
Figure 3C:
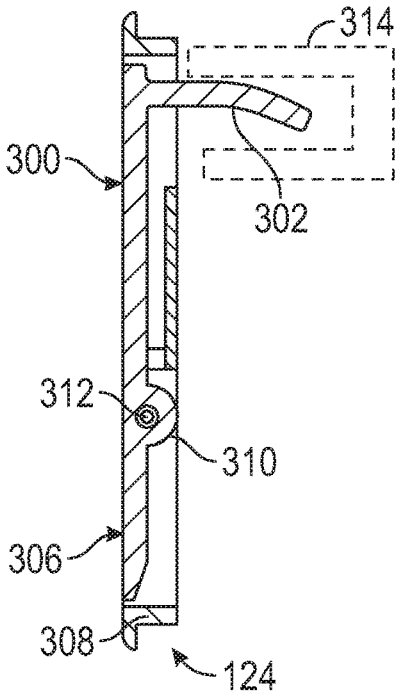
FIG. 3C is a side view of the screen latch of FIG. 3A in a locked position.
Figure 3D:
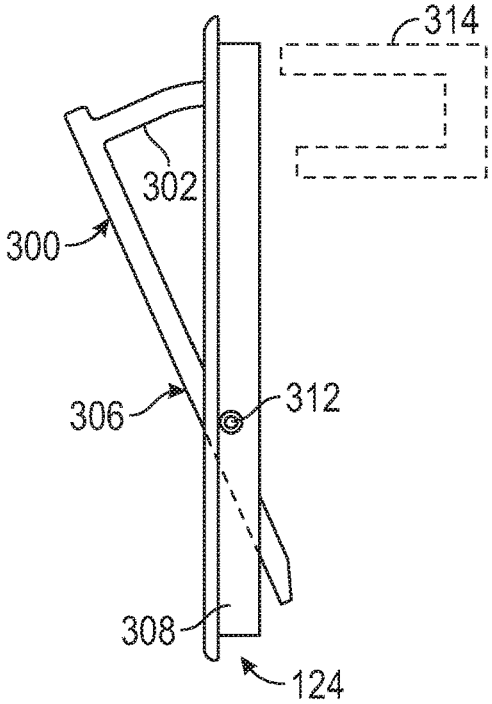
FIG. 3D is a side view of the screen latch of FIG. 3A in an unlocked position.

FIGS. 3A-3D illustrate generally an example screen latch 124 according to the present subject matter. FIG. 3A is an exploded view of one example of a screen latch 124. FIG. 3B is a perspective view of one example of a latch rocker 300. FIG. 3C is a side view of the screen latch 124 of FIG. 3A in a locked position. FIG. 3D is a side view of the screen latch 124 of FIG. 3A in an unlocked position. In certain examples, the screen latch 124 can include a latch rocker 300, a rocker housing 308, and a pivot pin 312. The latch rocker 300 can include rocker face 306, a rocker pivot 304, and a rocker anchor 302. The rocker housing can include a frame, an optional bezel, and pivot bearings 310. The screen latch 124 can be assembled by aligning the opening of the rocker pivot 304 of the latch rocker 300 between and with the pivot bearings 310 of the rocker housing 308 and inserting the pivot pin 312 through one pivot bearing 310, through the rocker pivot 304, and then through to the other pivot bearing 310 such that the ends of pivot pin 312 are positioned in a corresponding pivot bearing 310.

The screen latch 124 can be activated by pressing on the rocker face 306 at one of two ends. When the screen latch 124 is engaged in a locked position as illustrated in FIG. 3C, pressing on the end of the rocker face 306 opposite the rocker anchor 302 can pivot the latch rocker 300 to the unlocked position as shown in FIG. 3D. When the screen latch 124 is engaged in the unlocked position as illustrated in FIG. 3D, pressing on the end of the rocker face 306 adjacent the rocker anchor 302 can pivot the latch rocker 300 to the locked position as shown in FIG. 3C. In certain examples, the rocker housing 308 is integrated with the screen frame and the rocker anchor 302 can engage an anchor socket 314 of the fenestration frame 102 when the screen latch 124 is in the locked position. The engagement of rocker anchor 302 in the anchor socket 314 can restrict or limit the ability of the screen frame from being removed from the proximity of a corresponding portion of the fenestration frame. In general, the one or more screen latches 124 of a corresponding screen assembly can be engaged in a locked position when the screen frame is properly positioned within the fenestration frame and corresponding screen membrane spans the daylight opening.

Figure 4:
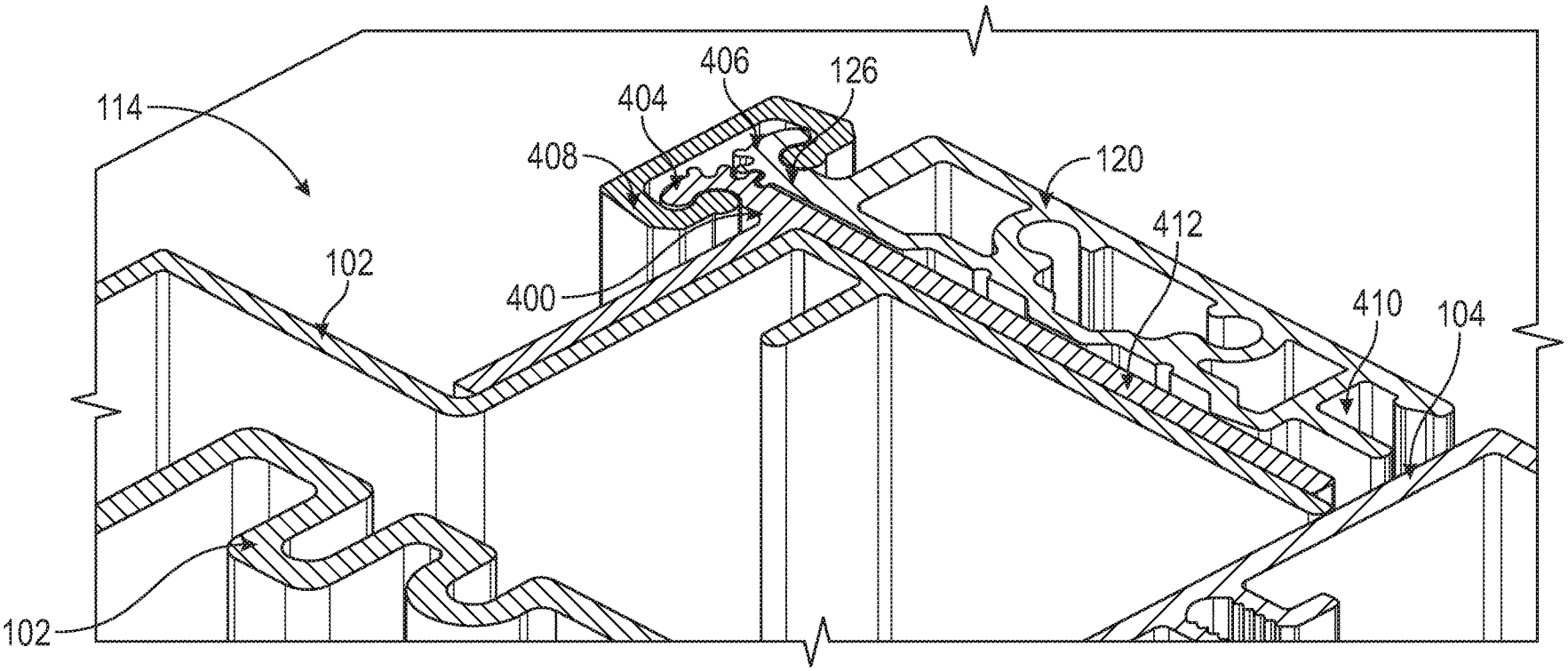
FIG. 4 is a detailed sectional view of one example of a screen hinge.

FIG. 4 illustrates generally a detailed sectional view of one example of a screen hinge assembly 126. The sectional view also includes cutaway portions of the fenestration frame 102 and fenestration panel 104. A hinge is part of a screen hinge assembly 126 that can also include a screen sash 412, screen frame 120, and a screen membrane (not shown). The screen frame 120 can include a pocket 410, or retention recess (e.g., FIG. 5, 502), opposite the screen hinge assembly 126, for insertion of a retaining spline (not shown). A retaining spline can be used to retain an edge of the screen membrane. The screen hinge assembly 126 can include a hinge base 400 directly coupled with or forming a part of the screen sash 412. In certain examples, the hinge base 400 can extend into a first meshing interface 412 of the screen hinge assembly 126. In some examples, the first meshing interface 412 can include gear-type cogs extending at least a portion of the length of the screen hinge assembly 126. A hinge operator 402 can include a second meshing interface 406 couple to or extending from the screen frame 120. The hinge operator 402, and screen frame 120 can be rotatable relative to the hinge base 400 and the screen sash 412. In certain examples, the second meshing interface 406 can include gear-type cogs extending at least a portion of the length of screen frame 120. An interface clamp 408 can engage a center pocket of the first meshing interface 404 and a center pocket of the second meshing interface 406, and can operate to keep the gear-type cogs of each interface 406, 408 engaged with one another while stationary and also while the second meshing interface 406 is rotated about the first meshing interface 408 to allow the screen frame 120 to open relative to the daylight opening of the fenestration frame. The screen sash 412 can be anchored to the fenestration frame 102. In certain examples, the screen sash 412 can be coupled to the fenestration frame using one or more fasteners such as, but no limited to, screws, nails, latches, clasps, or the like. In certain examples, the fasteners allow the screen sash 412 to be removably coupled to the fenestration frame 102 to allow the low-profile screen assembly 114 to be easily removed and re-installed such as for cleaning. The coupling of the screen sash 412 with the fenestration frame 102 generally prevents the low-profile screen assembly 114 from unprovoked removal from the fenestration frame 120 regardless of whether the screen panel 118 is in an open position or closed position with respect to the daylight opening 106.

Figure 5A:
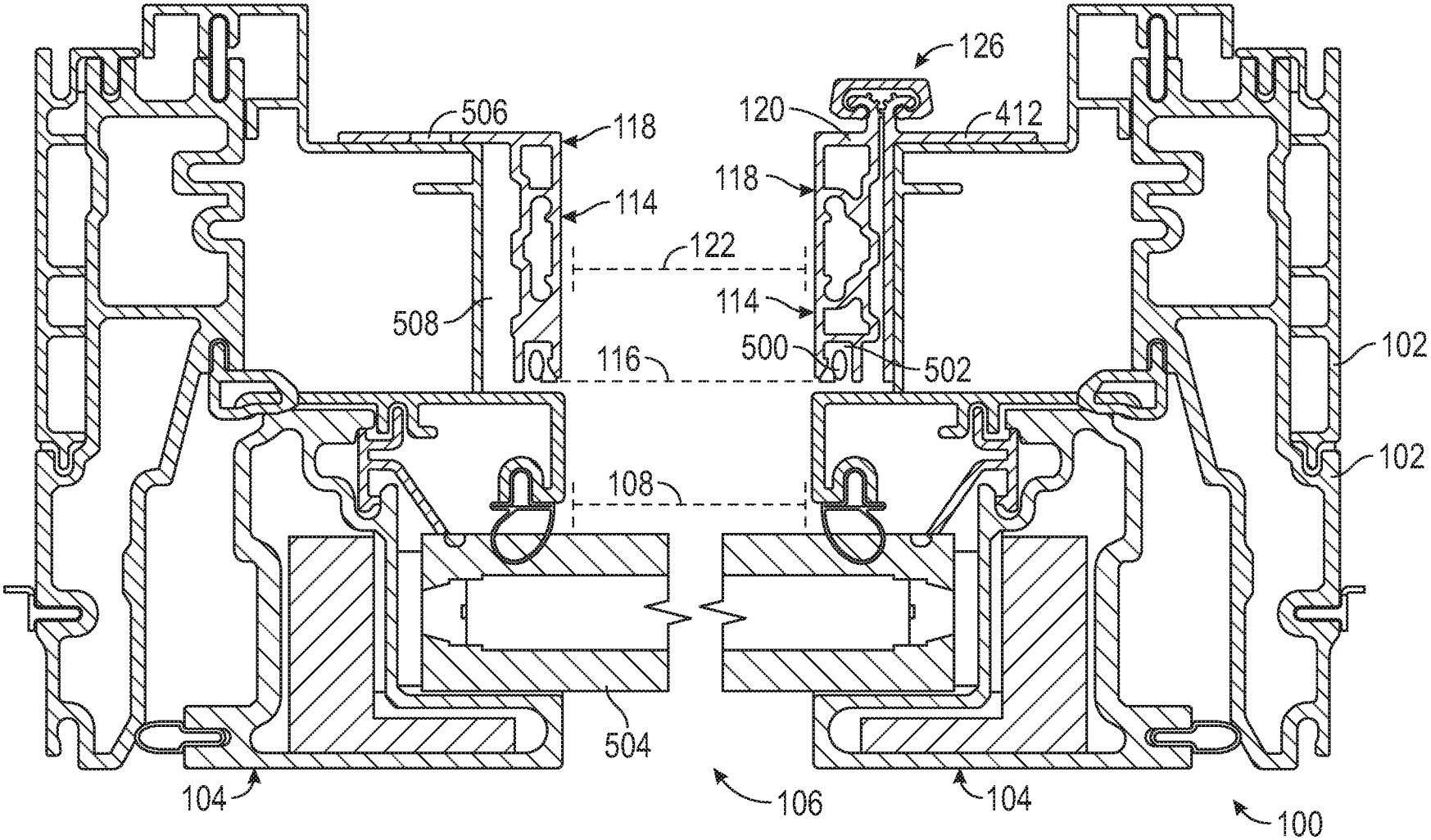
FIG. 5A is a first cross sectional view of the fenestration assembly of FIG. 1 including the example screen hinge.
Figure 5B:
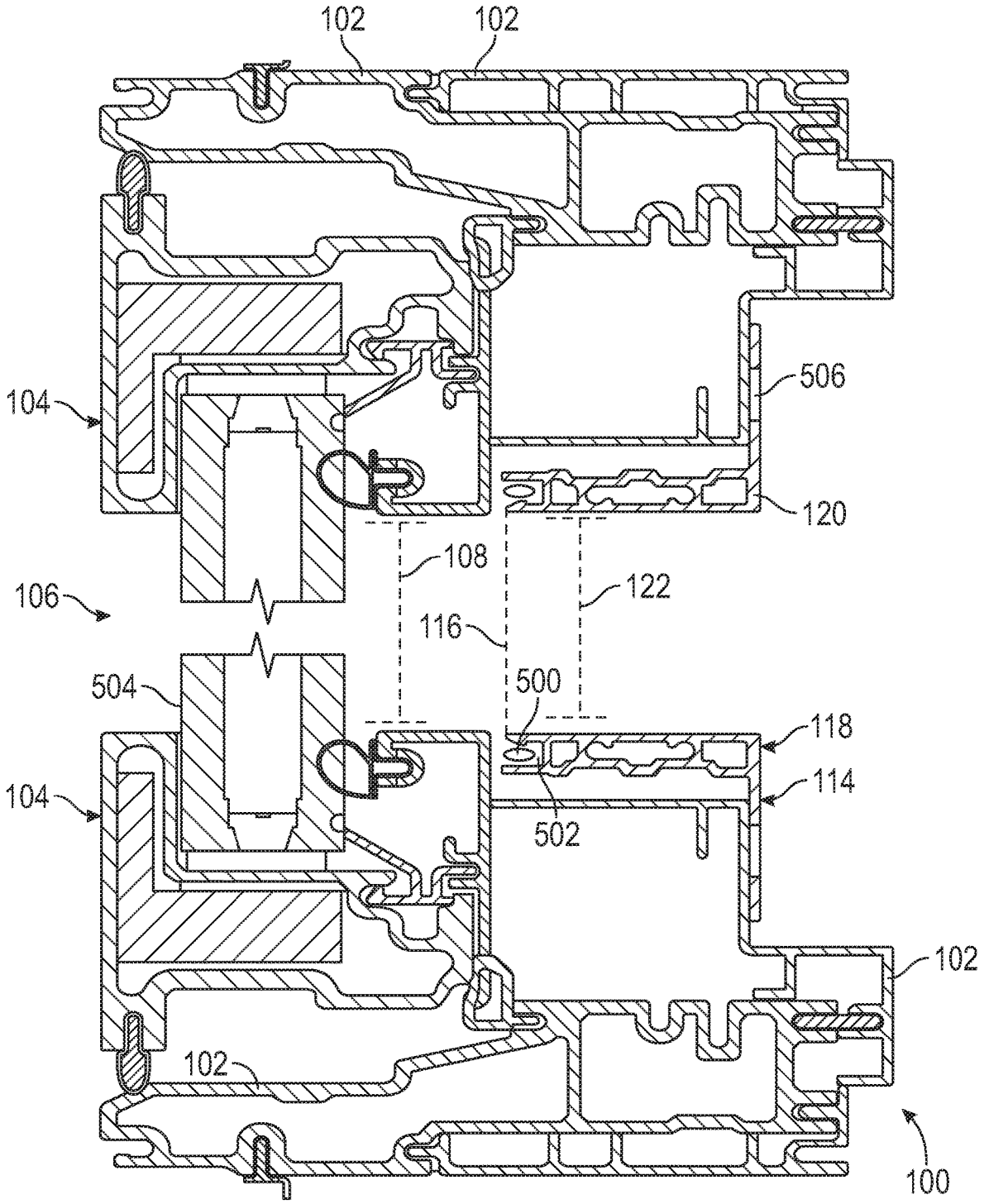
FIG. 5B is a second cross sectional view of the fenestration assembly of FIG. 1.

FIGS. 5A and 5B are first and second cross sectional views of the fenestration assembly 100 of FIG. 1 that includes an example screen hinge assembly 126. FIG. 5A illustrates generally parallel components of the fenestration assembly 100 where one of the parallel components includes the example screen hinge assembly 126. FIG. 5B illustrates generally second parallel components of the fenestration assembly 100 that extend between the fenestration components of FIG. 5A. The fenestration assembly 100 can include a fenestration frame 102, a fenestration panel 104 and a low-profile screen assembly 114.

The fenestration frame 102 can define a daylight opening 106 and a daylight opening profile 108, and a screen socket 508. The fenestration panel 104 can mount within a pocket of the fenestration frame 102 and can include a glass panel 504 spanning the daylight opening 106. The low-profile screen assembly 104 can include a screen panel 118 and the screen hinge 126. The screen panel 118 can include a screen frame 120 and a screen membrane 116. In certain examples, the screen membrane 116 and a first portion of the screen frame 120 can be rotatably coupled to a screen sash 412 of the low-profile screen assembly 114 to allow the screen membrane 116 to be opened with respect to the fenestration frame 102. The screen frame 120 can define a screen frame inner perimeter 122. In certain examples, the screen frame inner perimeter 122 defines an opening at least coextensive with the daylight opening profile 108 or daylight opening 106 of the fenestration frame 102.

In some examples, the screen frame inner perimeter 122 can be mis-aligned with the daylight opening 106 and similarly outside the daylight opening profile 108. Accordingly, the screen frame 120 does not obscure or interrupt the daylight opening 106. In certain examples, misalignment of the screen frame inner perimeter 122 can include the screen latch (not shown) having optional and incidental projection into the daylight opening 106. For instance, the screen latch can be recessed flush with the screen frame 120 of the screen panel 118 and may include an incidental projection of less than ⅛ inch (in.) or less, 1/16 in. or less into the daylight opening 106 or the like.

In some examples, the screen frame 120 or the screen sash 412 can include a seat flange 506. The seat flange 506 can provide a surface-to-surface coupling along a sash of the fenestration frame 102. In some examples, the seat flange 506 can blend the profile of the low-profile screen assembly 114 into the fenestration panel 104. In some examples, the seat flange 506 can provide a seamless appearance with the fenestration panel 104 and the fenestration frame 102 by bridging any gaps between the fenestration panel 104 and the fenestration frame 102.

In certain examples, an end of the screen frame 120, extending toward the daylight opening 106 when the screen frame 120 is latched within the screen socket 508, can include a retention mechanism for holding the screen membrane 116. In some examples, the retention mechanism can include a retention recess 502 for receiving and capturing a portion or edge of the screen membrane 116 and a retention spline 500 when the screen membrane 116 is at least partially wrapped about the retention spline 500.

Figure 6A:
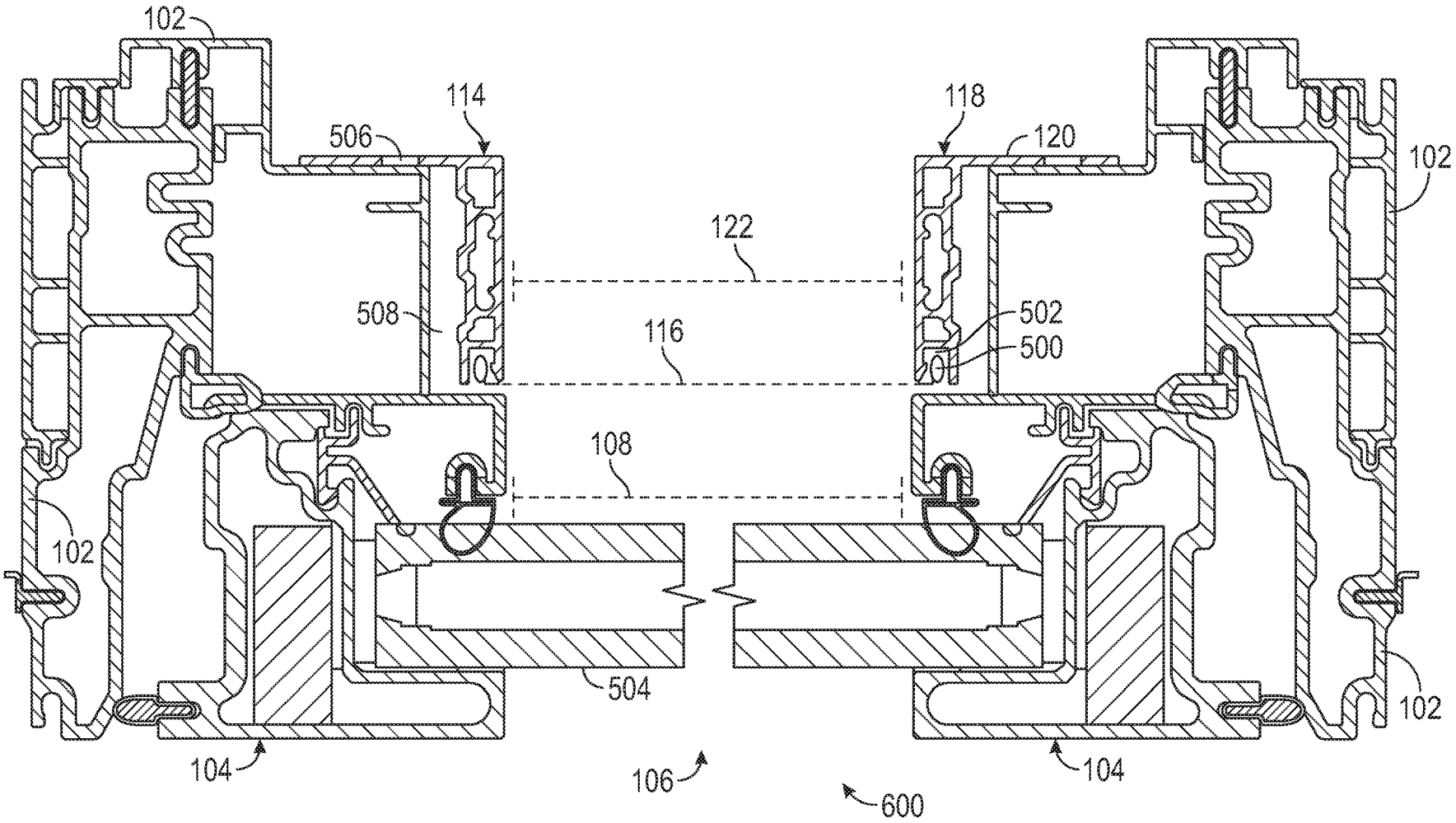
FIG. 6A is a first cross sectional view of another example of a fenestration assembly without a screen hinge.
Figure 6B:
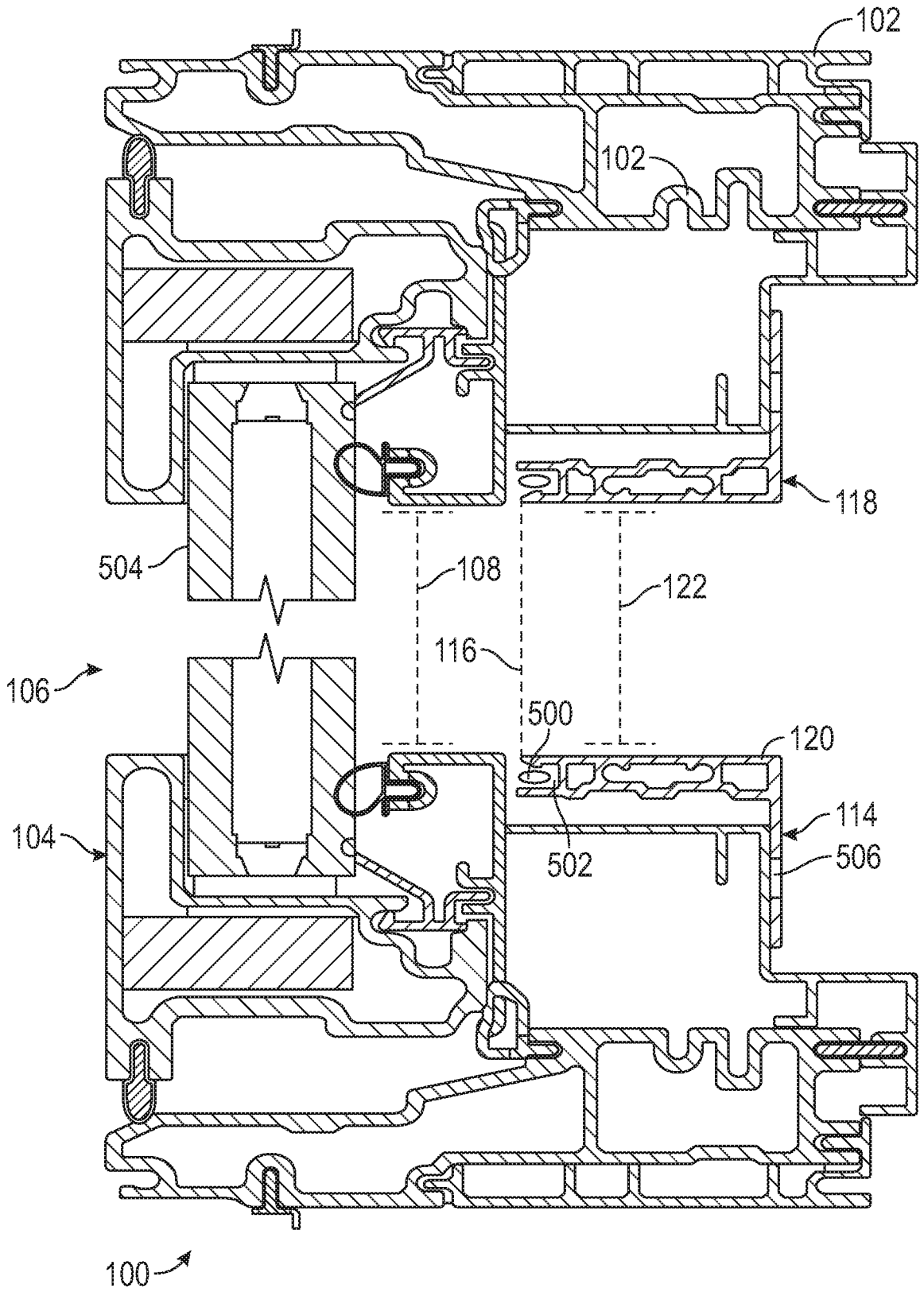
FIG. 6B is a second cross sectional view of the fenestration assembly of FIG. 6A.

FIGS. 6A and 6B are first and second cross sectional views of a fenestration assembly 600 without a screen hinge. FIG. 6A illustrates generally first parallel components of the fenestration assembly 600. FIG. 6B illustrates generally second parallel components of the fenestration assembly 600 that extend between the fenestration components of FIG. 6A. The fenestration assembly 600 can include a fenestration frame 102, a fenestration panel 104, and a low-profile screen assembly 114.

The fenestration frame 102 can define a daylight opening 106 and a daylight opening profile 108, and a screen socket 508. The fenestration panel 104 can mount within a pocket of the fenestration frame 102 and can include a glass panel 504 spanning the daylight opening 106. The low-profile screen assembly 114 can include a screen panel 118. The screen panel 118 can include a screen frame 120 and a screen membrane 116. The screen frame 120 can define a screen frame inner perimeter 122. In certain examples, the screen frame inner perimeter defines an opening at least coextensive with the daylight opening profile 108, or daylight opening 106, of the fenestration frame 102.

In some examples, the screen frame inner perimeter 122 can be mis-aligned with the daylight opening 106 and similarly outside the daylight opening profile 108. Accordingly, the screen frame 120 does not obscure or interrupt the daylight opening 106. In certain examples, misalignment of the screen frame inner perimeter 122 can include the screen latch (not shown) having optional and incidental projection into the daylight opening 106. For instance, the screen latch can be recessed flush with the screen frame 120 of eth screen panel 118 and may include an incidental projection of less than ⅛ inch (in.) or less, 1/16 in. or less into the daylight opening 106 or the like.

In some examples, the fenestration frame 102 can include a seat flange 506. The seat flange 506 can provide a surface-to-surface coupling along a sash of the fenestration frame 102. In some examples, the seat flange 506 can blend the profile of the low-profile screen assembly 114 into the fenestration panel 104. In some examples, the seat flange 506 can provide a seamless appearance with the fenestration panel 104 and the fenestration frame 102 by bridging any gaps between the fenestration panel 104 and the fenestration frame 102.

In certain examples, an end of the screen frame 120 extending toward the daylight opening 106 when the screen frame 120 is latched within the screen socket 508 can include a retention mechanism for holding the screen membrane 116. In some examples, the retention mechanism can include a retention recess 502 for receiving and capturing a portion or edge of the screen membrane 116 wrapped about a retention spline 500.

Figure 7A:
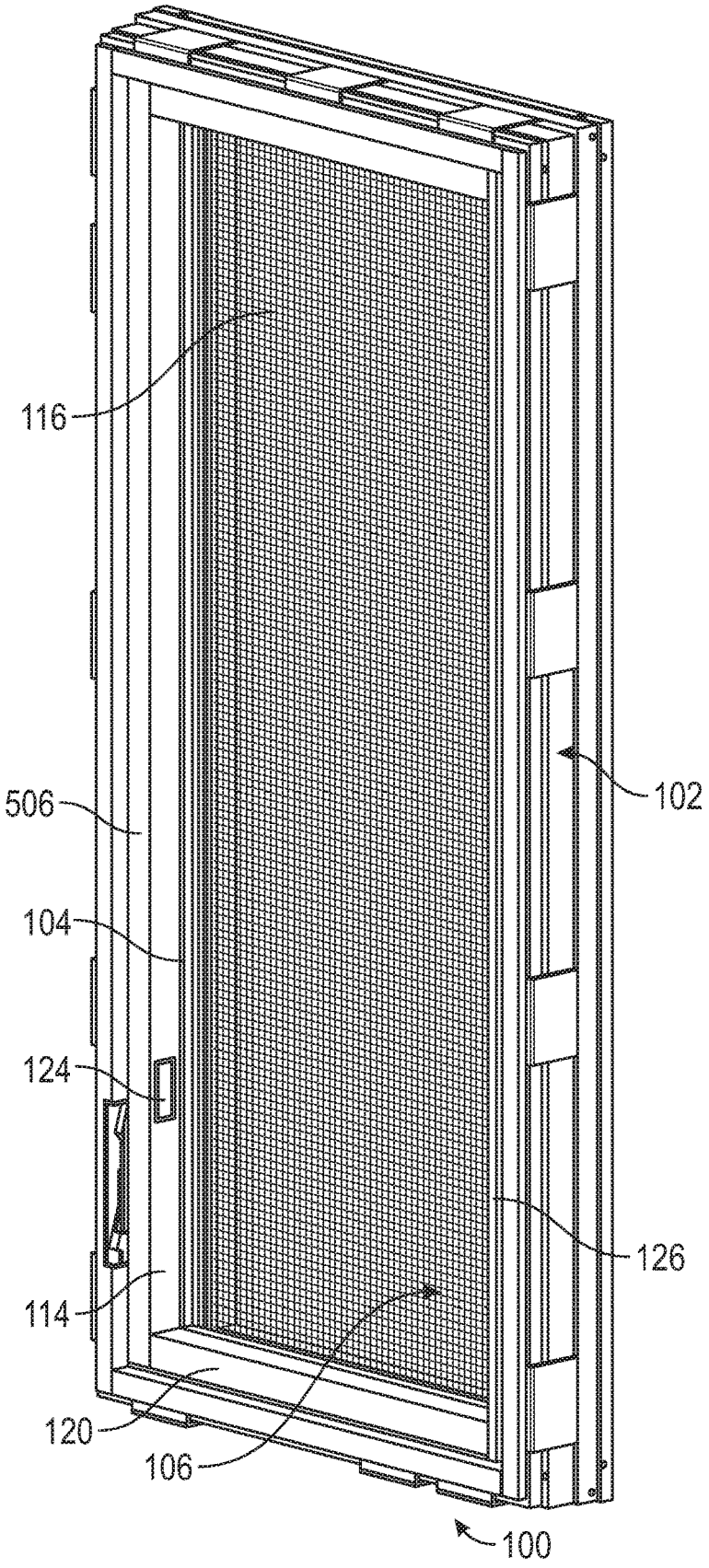
FIG. 7A is a detailed perspective view of the fenestration assembly of FIG. 1 in a closed configuration.
Figure 7B:
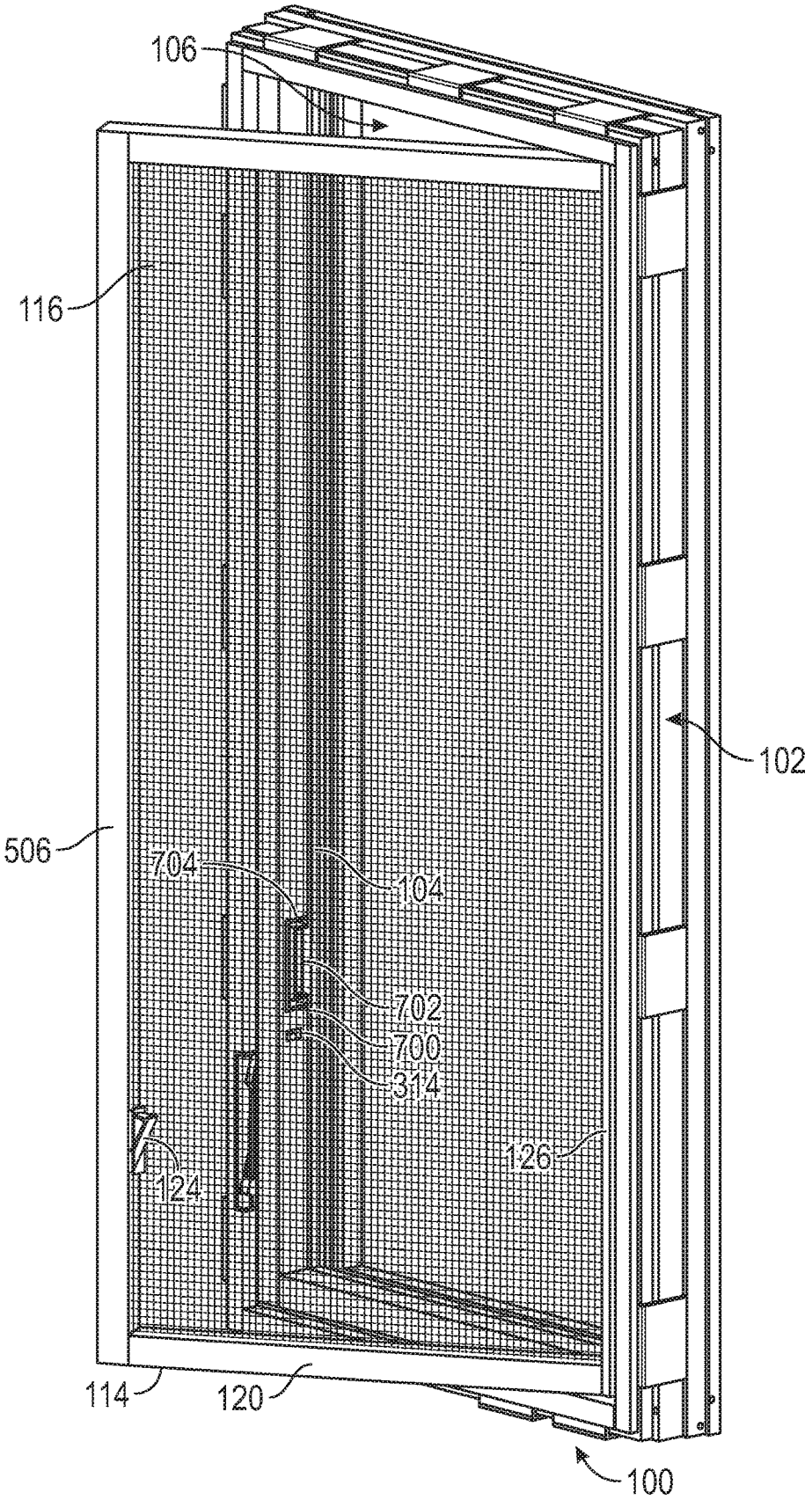
FIG. 7B is a detailed perspective view of the fenestration assembly of FIG. 1 in an open configuration.

FIG. 7A illustrates generally a detailed perspective view of an example fenestration assembly 100, such as the fenestration assembly FIG. 1, with a low-profile screen assembly 114 and fenestration panel 104 in a closed configuration. FIG. 7B illustrates generally a detailed perspective view of the fenestration assembly 100 of FIG. 7A with the low-profile screen assembly 114 in an open configuration. The fenestration assembly 100 can include a fenestration frame 102, the fenestration panel 104 and the low-profile screen assembly 114. In certain examples, the fenestration frame 102 can include a panel latch 110 to hold the fenestration panel 104 in a closed position. The illustrated low-profile screen assembly 114 includes an optional screen hinge assembly 126 to allow the screen frame 120 to pivot between an open position, and a closed position with respect to the fenestration frame 102. In the closed position (e.g., FIG. 7A), the plane defined by the screen membrane 116 is substantially adjacent and parallel to, and at least coextensive with a daylight opening 106 or daylight opening profile 108 defined by the fenestration frame 102, the fenestration panel 104, or a combination thereof. In the open position, the screen membrane 116 can be rotated via the screen hinge assembly 126 and screen frame 120 away from the fenestration panel 104. In certain examples, one or more members of the screen frame 120 can include a screen latch 124 to secure the hinged screen frame 120, and corresponding screen membrane 116, in the closed position. A screen latch 124 is typically located distal from the screen hinge assembly 126. As discussed above, the screen latch 124 can include a rocker anchor that can engage an anchor socket 314 of the fenestration frame 102 to hold the screen frame 120 in the closed position.

In some examples, the screen frame 120 can include a seat flange 506. The seat flange 506 can provide a surface-to-surface coupling along a sash of the fenestration frame 102. In some examples, the seat flange 506 can blend the profile of the low-profile screen assembly 114 into the fenestration panel 104. In some examples, the seat flange 506 can provide a seamless appearance with the fenestration panel 104 and the fenestration frame 102 by bridging any gaps between the fenestration panel 104 and the fenestration frame 102.

With reference to FIG. 7B, the screen frame 120 can be pivoted to move the screen membrane 116 away from the fenestration panel 104. Such movement may also be referred to as opening the screen membrane 116 with respect to the daylight opening 106. In certain examples, a user can toggle the screen latch 124 to allow the screen frame 120 and screen membrane 116 to be pivoted away from the fenestration panel 104. In certain examples, the toggle of the screen latch 124 can be accomplished by pressing an end of the exposed rocker face of the latch rocker of the screen latch 124 to disengage the rocker anchor from the anchor socket 314 such that the screen frame 120 and screen membrane 116 can be pivoted away from the fenestration panel.

In certain examples, once the screen frame 120 and screen membrane 116 are pivoted away from the fenestration panel 104, an optional, low-profile handle assembly 700 can be exposed in a sash or jamb of the fenestration frame 102 opposite the screen hinge assembly 126. The low-profile handle assembly 700 can include a handle socket 704 integrated within the sash or jamb of the fenestration frame 102 and a panel handle 702 coupled to a sash of the fenestration panel 104. The panel handle 702 can nestle into the handle socket 704 when the fenestration panel 104 is in a closed position. The panel handle 702 can assist a user in manually opening and closing the fenestration panel 104. In other examples, the fenestration assembly 100 may include an operator mechanism as discussed briefly above with respect to FIG. 1 (e.g., 113). The operator mechanism can include one or more of gears, sprockets, or linkage mechanisms to assist the user in opening and closing the fenestration panel 104. In some examples, the fenestration panel 104 may not be configured to open and close and therefore, may not include either an operator mechanism or a low-profile handle assembly 700. In certain examples, where allowed, the fenestration panel 104 may not be opened without first being released by the panel latch 110.

Various Notes and Aspects

Aspect 1 can include subject matter such as include a fenestration assembly having a low-profile screen comprising: a fenestration frame; a sash movably coupled with the fenestration frame, the sash includes a daylight opening having a daylight opening profile; and a low-profile screen assembly coupled with one or more of the fenestration frame or the sash, the low-profile screen assembly includes a screen panel having: a screen frame coupled along one or more of the sash or the fenestration frame, the screen frame includes a screen frame inner perimeter; a screen membrane spanning the screen frame and is coupled with the screen frame; and wherein the screen frame inner perimeter is outside of the daylight opening profile.

Aspect 2 can include or can optionally be combined with the subject matter of Aspect 1, to optionally include wherein the sash includes a sash frame having a sash frame profile and the screen frame includes a screen frame profile, and the screen frame profile corresponds with the sash frame profile.

Aspect 3 can include or can optionally be combined with the subject matter of one or any combination of Aspects 1 or 2 to optionally include wherein the sash includes a sash frame having a sash frame profile and the screen frame includes a screen frame profile, and the screen frame profile overlies the sash frame profile.

Aspect 4 can include, or can optionally be combined with the subject matter of one or any combination of Aspects 1-3 to optionally include wherein the sash includes a sash frame having a sash frame profile and the screen frame includes a screen frame profile, and the screen frame profile is aligned with the sash frame profile and misaligned with the daylight opening profile.

Aspect 5 can include, or can optionally be combined with the subject matter of one or any combination of Aspects 1-4 to optionally include wherein the screen panel includes a screen latch including: a latch rocker rotatably coupled with the screen frame; and a rocker anchor coupled with the latch rocker, the rocker anchor is configured for complementary reception in an anchor socket.

Aspect 6 can include, or can optionally be combined with the subject matter of Aspects 1-5 to optionally include wherein the latch rocker includes a rocker pivot, and the latch rocker is pivotable between locked and unlocked positions: in the locked position the rocker anchor is received in the anchor socket and the sash is arrested from moving; and in the unlocked position the latch rocker is pivoted around the rocker pivot relative to the latched position and the rocker anchor is recessed from the rocker anchor socket, and the sash is released for moving.

Aspect 7 can include or can optionally be combined with the subject matter of Aspects 1-6 to optionally include wherein the latch rocker includes a pivot pin proximate the rocker pivot, and the pivot bin is configured to bias the latch rocker toward the locked position.

Aspect 8 can include or can optionally be combined with the subject matter of Aspects 1-7 to optionally include wherein anchor socket is included in one of the sashes or the fenestration frame.

Aspect 9 can include or can optionally be combined with the subject matter of Aspects 1-8 to optionally include wherein one or more of the fenestration frame or the sash includes a screen socket configured to receive the screen frame, the screen socket extends outwardly from proximate the daylight opening profile.

Aspect 10 can include or can optionally be combined with the subject matter of Aspects 1-9 to optionally include wherein the screen frame includes a blending flange extending from a remainder of the screen frame toward the fenestration frame, and the blending flange is configured to blend the screen frame into one or more of the sash or the fenestration frame.

Aspect 11 can include, or can optionally be combined with the subject matter of Aspects 1-10 to optionally include a fenestration assembly having a low-profile screen comprising: a fenestration frame; a sash movably coupled with the fenestration frame, the sash includes a daylight opening having a daylight opening profile; and a low-profile screen assembly coupled with one or more of the fenestration frame or the sash, the low-profile screen assembly includes: a screen frame having a screen frame inner perimeter; a screen membrane spanning the screen frame and coupled with the screen frame; a screen hinge coupled between the fenestration frame and the screen frame; a screen latch coupled with the screen frame, the screen latch includes a latch rocker configured to pivotally lock and unlock the screen frame from the fenestration frame; and wherein the screen frame is outside of the daylight opening profile, and the daylight opening is unobstructed at least from the sash through the low-profile screen assembly.

Aspect 12 can include or can optionally be combined with the subject matter of Aspects 1-11 to optionally include wherein the sash includes a sash frame surrounding the daylight opening, and the screen frame is aligned with the sash frame.

Aspect 13 can include or can optionally be combined with the subject matter of Aspects 1-12 to optionally include wherein the sash frame includes a sash frame profile, and a screen frame profile of the screen frame is inside of the sash frame profile.

Aspect 14 can include or can optionally be combined with the subject matter of Aspects 1-13 to optionally include wherein the screen frame includes a seat flange extending from the remainder of the screen frame toward the fenestration frame, and the seat flange is configured to blend the screen frame with a sash frame of the fenestration frame.

Aspect 15 can include, or can optionally be combined with the subject matter of Aspects 1-14 to optionally include wherein the screen frame is rotatable between closed and open configurations: in the closed configuration the screen frame is coupled along the fenestration frame, and the screen membrane extends across the daylight opening; and in the open configuration the screen frame is rotated relative to the closed configuration around the screen hinge, and the sash is accessible from an interior side of the fenestration assembly.

Aspect 16 can include or can optionally be combined with the subject matter of Aspects 1-15 to optionally include wherein the screen frame includes a seat flange extend along the remainder of the screen frame, and in the closed configuration the seat flange is coupled in surface to surface contact with the fenestration frame.

Aspect 17 can include or can optionally be combined with the subject matter of Aspects 1-16 to optionally include wherein the latch rocker includes a rocker anchor, and the rocker anchor is configured for complementary reception in an anchor socket.

Aspect 18 can include, or can optionally be combined with the subject matter of Aspects 1-17 to optionally include wherein the latch rocker includes a rocker pivot, and the latch rocker is pivotable between locked and unlocked positions: in the locked position the rocker anchor is received in the anchor socket and the screen frame is arrested from moving; and in the unlocked position the latch rocker is pivoted around the rocker pivot relative to the latched position and the rocker anchor is recessed from the rocker anchor socket, and the screen frame is released for moving.

Aspect 19 can include or can optionally be combined with the subject matter of Aspects 1-18 to optionally include wherein the latch rocker includes a pivot pin proximate the rocker pivot, and the pivot pin is configured to bias the latch rocker toward the locked position.

Aspect 20 can include or can optionally be combined with the subject matter of Aspects 1-19 to optionally include wherein the anchor socket is included in the fenestration frame.

Aspect 21 can include or can optionally be combined with the subject matter of Aspects 1-20 to optionally include wherein the screen latch is flush mounted to the screen frame.

Aspect 22 can include or can optionally be combined with the subject matter of Aspects 1-21 to optionally include wherein the screen latch is flush mounted relative to the screen frame inner perimeter.

Aspect 23 can include or can optionally be combined with the subject matter of Aspects 1-22 to optionally include wherein the screen hinge includes: a hinge base coupled with the fenestration frame; a hinge operator coupled with the screen frame, the hinge operator configured to rotate with the screen frame relative to the hinge base.

Aspect 24 can include or can optionally be combined with the subject matter of Aspects 1-23 to optionally include wherein the hinge base includes a first meshing interface and the hinge operator includes a second meshing interface complementary to the first meshing interface.

Aspect 25 can include or can optionally be combined with the subject matter of Aspects 1-24 to optionally include wherein the screen hinge includes an interface clamp bridging the first and second meshing interfaces, and the interface clamp is configured to maintain engagement between the first and second meshing interfaces.

Aspect 26 can include or can optionally be combined with the subject matter of Aspects 1-25 to optionally include wherein the first and second meshing interfaces extend along an edge of the fenestration frame and the screen frame, respectively.

Aspect 27 can include or can optionally be combined with the subject matter of Aspects 1-26 to optionally include wherein the low-profile screen assembly includes a screen jamb having the hinge base, and the screen jamb is coupled along the fenestration frame.

Aspect 28 can include, or can optionally be combined with the subject matter of Aspects 1-27 to optionally include a low-profile screen assembly comprising: a frame having a frame inner perimeter; a screen membrane spanning the frame and coupled with the frame; a screen latch flush to the frame inner perimeter, the screen latch includes: a latch rocker pivotally coupled with the frame; and a rocker anchor extending from the latch rocker, the rocker anchor in a locked configuration is configured to lock the screen frame when seated in an anchor socket of a fenestration assembly; and a screen hinge coupled along the frame, the screen hinge is configured to rotatably couple the frame with the fenestration assembly, the screen hinge includes: a hinge base configured for coupling with the fenestration assembly; and a hinge operator coupled with the frame, the hinge operator is configured to rotate with the frame and screen membrane relative to the hinge base.

Aspect 29 can include or can optionally be combined with the subject matter of Aspects 1-28 to optionally include wherein the screen latch includes a rocker face, and depression of the rocker face into the frame is configured to unseat the rocker anchor from the anchor socket.

Aspect 30 can include or can optionally be combined with the subject matter of Aspects 1-29 to optionally include wherein the screen latch includes a rocker pivot between the rocker face and the rocker anchor.

Aspect 31 can include or can optionally be combined with the subject matter of Aspects 1-30 to optionally include wherein the latch rocker is pivotable between locked and unlocked positions: in the locked position the latch rocker is flush with the frame inner perimeter; and in the unlocked position at least the rocker face is recessed relative to the frame inner perimeter.

Aspect 32 can include or can optionally be combined with the subject matter of Aspects 1-31 to optionally include the fenestration assembly including: a fenestration frame; and a sash movably coupled with the fenestration frame; wherein the sash includes a daylight opening having a daylight opening profile.

Aspect 33 can include or can optionally be combined with the subject matter of Aspects 1-32 to optionally include wherein the anchor socket is included in the fenestration frame.

Aspect 34 can include or can optionally be combined with the subject matter of Aspects 1-33 to optionally include wherein the hinge base includes a first meshing interface and the hinge operator includes a second meshing interface complementary to the first meshing interface.

Aspect 35 can include or can optionally be combined with the subject matter of Aspects 1-34 to optionally include wherein the screen hinge includes an interface clamp bridging the first and second meshing interfaces, and the interface clamp is configured to maintain engagement between the first and second meshing interfaces.

Aspect 36 can include or can optionally be combined with the subject matter of Aspects 1-35 to optionally include a screen jamb configured for coupling with a fenestration frame, and the hinge base is coupled along the screen jamb.

Aspect 37 can include, or can optionally be combined with the subject matter of Aspects 1-36 to optionally include a method of using a low-profile screen assembly comprising: unlocking the low-profile screen assembly from a fenestration assembly, unlocking includes: operating a screen latch on a screen frame, the screen latch and screen frame are outside of a daylight opening profile of the fenestration assembly; and decoupling the screen latch from the fenestration assembly with the operation; and opening the unlocked low-profile screen assembly relative to the fenestration assembly.

Aspect 38 can include or can optionally be combined with the subject matter of Aspects 1-37 to optionally include wherein operating the screen latch includes depressing the screen latch into the screen frame.

Aspect 39 can include or can optionally be combined with the subject matter of Aspects 1-38 to optionally include wherein the screen latch includes a latch rocker and depressing the screen latch includes pivoting the latch rocker.

Aspect 40 can include or can optionally be combined with the subject matter of Aspects 1-39 to optionally include wherein depressing the screen latch unseats a rocker anchor of the latch rocker from an anchor socket of the fenestration assembly.

Aspect 41 can include or can optionally be combined with the subject matter of Aspects 1-40 to optionally include wherein depressing the screen latch includes depressing a rocker face of the latch rocker.

Aspect 42 can include or can optionally be combined with the subject matter of Aspects 1-41 to optionally include wherein the operating the screen latch includes toggling the screen latch to an unlocked position, and the toggled screen latch remains in the unlocked position until operation is repeated.

Aspect 43 can include or can optionally be combined with the subject matter of Aspects 1-42 to optionally include wherein opening the unlocked low-profile screen assembly includes rotating the screen frame at a screen hinge coupling the screen frame with the fenestration assembly.

Each of these non-limiting aspects can stand on its own or can be combined in various permutations or combinations with one or more of the other aspects.

The above description includes references to the accompanying drawings, which form a part of the detailed description. The drawings show, by way of illustration, specific embodiments in which the invention can be practiced. These embodiments are also referred to herein as "aspects" or "examples." Such aspects or example can include elements in addition to those shown or described. However, the present inventors also contemplate aspects or examples in which only those elements shown or described are provided. Moreover, the present inventors also contemplate aspects or examples using any combination or permutation of those elements shown or described (or one or more features thereof), either with respect to a particular aspects or examples (or one or more features thereof), or with respect to other Aspects (or one or more features thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

The above description is intended to be illustrative, and not restrictive. For example, the above-described aspects or examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as aspects, examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A fenestration assembly having a low-profile screen comprising:

- a fenestration frame;
- a sash movably coupled with the fenestration frame, the sash includes:
  - a sash frame having a sash frame inner perimeter and a sash frame outer perimeter; and
  - a daylight opening having a daylight opening profile; and
- a low-profile screen assembly coupled with one or more of the fenestration frame or the sash, the low-profile screen assembly includes a screen panel having:
  - a screen frame coupled along one or more of the sash or the fenestration frame, the screen frame between the sash frame inner and outer perimeters, the screen frame includes:
    - a screen frame inner perimeter; and
    - a seat flange extending from a remainder of the screen frame toward the fenestration frame, and the seat flange is configured to blend the screen frame with the fenestration frame:
  - a screen membrane spanning the screen frame and is coupled with the screen frame;
  - a screen hinge coupled between the fenestration frame and the screen frame;

a screen latch coupled with the screen frame, the screen latch includes a latch rocker configured to pivotally lock and unlock the screen frame from the fenestration frame; and wherein the screen frame inner perimeter is outside of the daylight opening profile.

2. The fenestration assembly of claim 1, wherein the sash frame includes a sash frame profile and the screen frame includes a screen frame profile, and the screen frame profile corresponds with the sash frame profile.

3. The fenestration assembly of claim 1, wherein the sash frame includes a sash frame profile and the screen frame includes a screen frame profile, and the screen frame profile overlies the sash frame profile.

4. The fenestration assembly of claim 1, wherein the sash frame includes a sash frame profile and the screen frame includes a screen frame profile, and the screen frame profile is aligned with the sash frame profile and misaligned with the daylight opening profile.

5. The fenestration assembly of claim 1, wherein the screen panel includes a screen latch including:

a latch rocker rotatably coupled with the screen frame; and a rocker anchor coupled with the latch rocker, the rocker anchor is configured for complementary reception in an anchor socket.

6. The fenestration assembly of claim 5, wherein the latch rocker includes a rocker pivot, and the latch rocker is pivotable between locked and unlocked positions:

in the locked position the rocker anchor is received in the anchor socket and the screen panel is arrested from moving, and in the unlocked position the latch rocker is pivoted around the rocker pivot relative to the latched position and the rocker anchor is recessed from the anchor socket, and the screen panel is released for moving.

7. The fenestration assembly of claim 6, wherein the latch rocker includes a pivot pin proximate the rocker pivot, and the pivot pin is configured to bias the latch rocker toward the locked position.

8. The fenestration assembly of claim 5, wherein the anchor socket is included in one of the sash or the fenestration frame.

9. The fenestration assembly of claim 1, wherein one or more of the fenestration frame or the sash includes a screen socket configured to receive the screen frame, the screen socket extends outwardly from proximate the daylight opening profile.

10. The fenestration assembly of claim 9, wherein the screen frame includes a blending flange extending from a remainder of the screen frame toward the fenestration frame, and the blending flange is configured to blend the screen frame into one or more of the sash or the fenestration frame.

11. A fenestration assembly having a low-profile screen comprising:

a fenestration frame;

a sash movably coupled with the fenestration frame, the sash includes a sash frame extending around a daylight opening having a daylight opening profile, the sash frame having a sash frame inner perimeter and a sash frame outer perimeter; and a low-profile screen assembly coupled with one or more of the fenestration frame or the sash, the low-profile screen assembly includes:

a screen frame having a seat flange extending from a remainder of the screen frame toward the fenestration frame, and the seat flange is configured to blend the screen frame with the fenestration frame, the screen frame between the sash frame inner and outer perimeters;

a screen membrane spanning the screen frame and coupled with the screen frame;

a screen hinge coupled between the fenestration frame and the screen frame;

a screen latch coupled with the screen frame, the screen latch includes a latch rocker configured to pivotally lock and unlock the screen frame from the fenestration frame; and wherein the screen frame is outside of the daylight opening profile, and the daylight opening is unobstructed at least from the sash through the low-profile screen assembly.

12. The fenestration assembly of claim 11, wherein screen frame is aligned with the sash frame.

13. The fenestration assembly of claim 12, wherein the sash frame includes a sash frame profile, and a screen frame profile of the screen frame is inside of the sash frame profile.

14. The fenestration assembly of claim 11, wherein the screen frame is rotatable between closed and open configurations:

in the closed configuration the screen frame is coupled along the fenestration frame, and the screen membrane extends across the daylight opening; and in the open configuration the screen frame is rotated relative to the closed configuration around the screen hinge, and the sash is accessible from an interior side of the fenestration assembly.

15. The fenestration assembly of claim 14, wherein the seat flange extends along a remainder of the screen frame, and in the closed configuration the seat flange is coupled in surface to surface contact with the sash frame.

16. The fenestration assembly of claim 11, wherein the latch rocker includes a rocker anchor, and the rocker anchor is configured for complementary reception in an anchor socket.

17. The fenestration assembly of claim 16, wherein the latch rocker includes a rocker pivot, and the latch rocker is pivotable between locked and unlocked positions:

in the locked position the rocker anchor is received in the anchor socket and the screen frame is arrested from moving; and in the unlocked position the latch rocker is pivoted around the rocker pivot relative to the latched position and the rocker anchor is recessed from the anchor socket, and the screen frame is released for moving.

18. The fenestration assembly of claim 17, wherein the latch rocker includes a pivot pin proximate the rocker pivot, and the pivot pin is configured to bias the latch rocker toward the locked position.

19. The fenestration assembly of claim 16, wherein the anchor socket is included in the fenestration frame.

20. The fenestration assembly of claim 11, wherein the screen latch is flush mounted to the screen frame.

21. The fenestration assembly of claim 11, wherein the screen latch is flush mounted relative to a screen frame inner perimeter.

22. The fenestration assembly of claim 11, wherein the screen hinge includes:

a hinge base coupled with the fenestration frame; and a hinge operator coupled with the screen frame, the hinge operator configured to rotate with the screen frame relative to the hinge base.

23. The fenestration assembly of claim 22, wherein the hinge base includes a first meshing interface and the hinge operator includes a second meshing interface complementary to the first meshing interface.

24. The fenestration assembly of claim 23, wherein the screen hinge includes an interface clamp bridging the first and second meshing interfaces, and the interface clamp is configured to maintain engagement between the first and second meshing interfaces.

25. The fenestration assembly of claim 23, wherein the first and second meshing interfaces extend along an edge of the fenestration frame and the screen frame, respectively.

26. The fenestration assembly of claim 22, wherein the low-profile screen assembly includes a screen jamb having the hinge base, and the screen jamb is coupled along the fenestration frame.

* * * * *